United States Patent [19]

Nagahara et al.

[11] Patent Number: 4,904,832

[45] Date of Patent: Feb. 27, 1990

[54] MICROSWITCH

[75] Inventors: Toyohiro Nagahara, Shimane; Takashi Niwa, Kyoto; Takezo Sano, Shiga; Isao Kato, Ootsu, all of Japan

[73] Assignee: Omron Tateisi Electronics Co., Kyoto, Japan

[21] Appl. No.: 249,648

[22] Filed: Sep. 27, 1988

[30] Foreign Application Priority Data

Oct. 8, 1987 [JP] Japan ..... 62-254401
Oct. 8, 1987 [JP] Japan ..... 62-154541

[51] Int. Cl.[4] ..... H01H 5/00

[52] U.S. Cl. ..... 200/402; 200/453

[58] Field of Search ..... 200/283, 402, 405, 407, 200/430, 450, 453, 456, 458, 459, 468, 451, 454, 457

[56] References Cited

U.S. PATENT DOCUMENTS

| | | | |
|---|---|---|---|
| 2,374,986 | 5/1945 | Fetter | 200/454 |
| 3,604,879 | 9/1971 | Beer | 200/453 |
| 3,989,914 | 11/1976 | Stearley et al. | 200/453 |
| 4,045,632 | 8/1977 | Pierrot | 200/454 |

FOREIGN PATENT DOCUMENTS

| | | |
|---|---|---|
| 118870 | 9/1984 | European Pat. Off. . |
| 219564 | 4/1987 | European Pat. Off. . |
| 224402 | 6/1987 | European Pat. Off. . |
| 1529781 | 5/1968 | France . |
| 2530862 | 1/1984 | France . |

*Primary Examiner*—Henry J. Recla
*Assistant Examiner*—Glenn T. Barrett
*Attorney, Agent, or Firm*—Wegner & Bretschneider

[57] ABSTRACT

A microswitch in which a good snap action feeling is obtained and an operating stroke is enhanced is provided. A compession spring is interposed between a movable member and a swingable lever which are respectively pivotaly supported at close positions. The swingable lever is operated by a push button which is vertically slidable. Further, restricting plates to restrict the motion in the width direction of the movable member are attached to the push button. A positioning member to hold the swingably lever to the position which faces the push button when the microswitch is assembled is also provided.

4 Claims, 7 Drawing Sheets

32
21
33
12
12b
10
35
12c
22
31
30
26b
26a
26
28
23b
23a
23
24
27
18b
29
18
19
37
36
18a
20
13a
11a
15a
17
11b
14a
25
13
11
34
14
15

MICROSWITCH

BACKGROUND OF THE INVENTION

1. Field of the Invention

The present invention relates to a microswitch.

2. Prior Art Statement

A typical microswitch is shown in FIG. 1 as one of conventional general microswitches. A switch casing 102 is constructed by a cover 101 and a switch casing main body 103. A pair of a terminal member for normally closed contact and a terminal member 105 for normally open contact and a common terminal member 106 are fixed to the main body 103. Fixed contacts 107 and 108 are fixed to inner end portions 104*a* and 105*a* of the fixed terminal members 104 and 105, respectively. A movable contact member 110 is pivotally supported to the inner end portion 106*a* of the common terminal member 106 at the base end thereof. The movable contact member 110 has a movable contact 109 at the front end thereof, the movable contact 109 being come into contact with or removed from the fixed contacts 107 and 108, respectively. A compression leaf spring 111 is attached between the front end side of the movable contact member 110 and the inner end portion 106*a* of the common terminal member 106. A push button 112 is inserted into a hole 102*a* formed in the top plate of the switch casing 102. By depressing the push button 112, the movable contact member 110 is moved, thereby switching the contacting state of the movable contact 109 from the normally closed type fixed contact 107 to the normally open type fixed contact 108 by the snap action.

However, in such a microswitch, since the movable contact member 110 is directly operated by the push button 112, a degree of whole motion (a travelling amount of the push button 112 from its free position to the operating limit position) is small and its operating stroke amount is also limited to up to about 1 mm.

To solve this problem, means for assuring a large operating stroke is shown in FIG. 2. That is, the push button 112 is operated by an operating lever 113 which is pivotally attached to the switch casing 102. FIG. 3 shows another means for realizing a large operating stroke, in which a sub-button 115 which is pressed downwardly through a spring member 114 is inserted in the push button 112 and the movable contact member 110 is operated by the sub-button 115. However, the former means has a drawback such that a large space is needed for the operating lever 113. The latter means has a drawback such that the number of parts increases.

On the other hand, in any of the foregoing conventional microswitches, their operating characteristics are as shown in FIG. 4 and a load near the operating limit position suddenly increases, so that the good operating feeling cannot be obtained.

SUMMARY OF THE INVENTION

The present invention is made to solve the inconveniences in the foregoing conventional microswitches and it is an object of the present invention to provide a microswitch in which the size is small and compact, a good operating feeling is obtained, a large operating stroke is derived, and it can be easily automatically assembled.

According to the present invention, there is provided a microswitch in which a first common terminal member and at least one second terminal member for fixed contact are fixed to a lower plate portion of a switch casing, a hole is formed in a top plate of the switch casing at a position between the first common terminal member and the second terminal member, a push button is inserted into this hole so as to be vertically movable, a movable contact which faces a fixed contact provided on the second terminal member is provided in a free end portion of a movable member, a base end portion of the movable member is rotatably pivotally supported to an inner end portion of the first common terminal member, a base end portion of a swingable lever is pivotally swingably supported to the inner end portion of the first common terminal member, the swingable lever is operated by the push button, one end of a compression spring is engaged with the central portion of the swingable lever, the other end of the compression spring is engaged with the free end portion of the movable member, the swingable lever is pressed by the spring force of the compression spring, a swingable lever positioning projection is provided in the switch casing, and the free end portion of the swingable lever is deformed to a settable position of the push button by this positioning projection.

According to the present invention, the swingable lever is operated by the push button and the movable member is operated through the compression spring interposed between the swingable lever and the movable member. Therefore, although the microswitch is small, the operating stroke can be enhanced by the swingable lever. The number of parts is smaller than that of the conventional microswitch in which the operating stroke is increased by a spring member assembled in a push button. Further, the fulcrum of the compression spring is moved like an arc around a pivotal supporting portion of the swingable lever as a rotational center. Therefore, a sudden increase in load at a position near the operation limit position is suppressed, a good operating feeling is derived, particularly a large operating stroke is derived, and the assembling efficiency is high. Further, the swingable lever applied with the spring force of the compression spring is deformed to the settable position of the push button by the swingable lever positioning projection, so that this microswitch can be easily assembled.

According to another aspect of the invention, there is provided a microswitch in which a first common terminal member and at least one second terminal member for fixed contact are fixed to a lower plate portion of a switch casing, a hole is formed in a top plate of the switch casing at a position between the first common terminal member and the second terminal member, a push button is inserted into this hole so as to be vertically movable, a movable contact which faces a fixed contact provided on the second terminal member is provided in a free end portion of a movable member, a base end portion of the movable member is rotatably pivotally supported to an inner end portion of the first common terminal member, a base end portion of a swingable lever is pivotally swingably supported to the inner end portion of the first common terminal member, the swingable lever is operated by the push button, one end of a compression spring is engaged with the central portion of the swingable lever, the other end of the compression spring is engaged with the free end portion of the movable member, a pair of front and rear restricting plates to restrict the position of the movable member in the width direction are formed at a lower end portion of the push button, and a guide portion to guide the vertical motions of the restricting plates is formed on the inner wall of the switch casing.

According to the invention, the swingable lever is operated by the push button and the movable member is operated through the compression spring interposed between the swingable lever and the movable member. Therefore, although the microswitch is small, the operating stroke can be enhanced by the swingable lever. The number of parts is smaller than that of the conventional microswitch in which the operating stroke is increased by a spring member assembled in a push button. Further, the fulcrum of the compression spring is moved like an arc around a pivotal supporting portion of the swingable lever as a rotational center. Therefore, a sudden increase in load at a position near the operation limit position is suppressed and a good operating feeling is derived.

DETAILED DESCRIPTION OF THE PREFERRED EMBODIMENTS

An embodiment of the present invention will be described hereinbelow with reference to the drawings.

Figure 5:
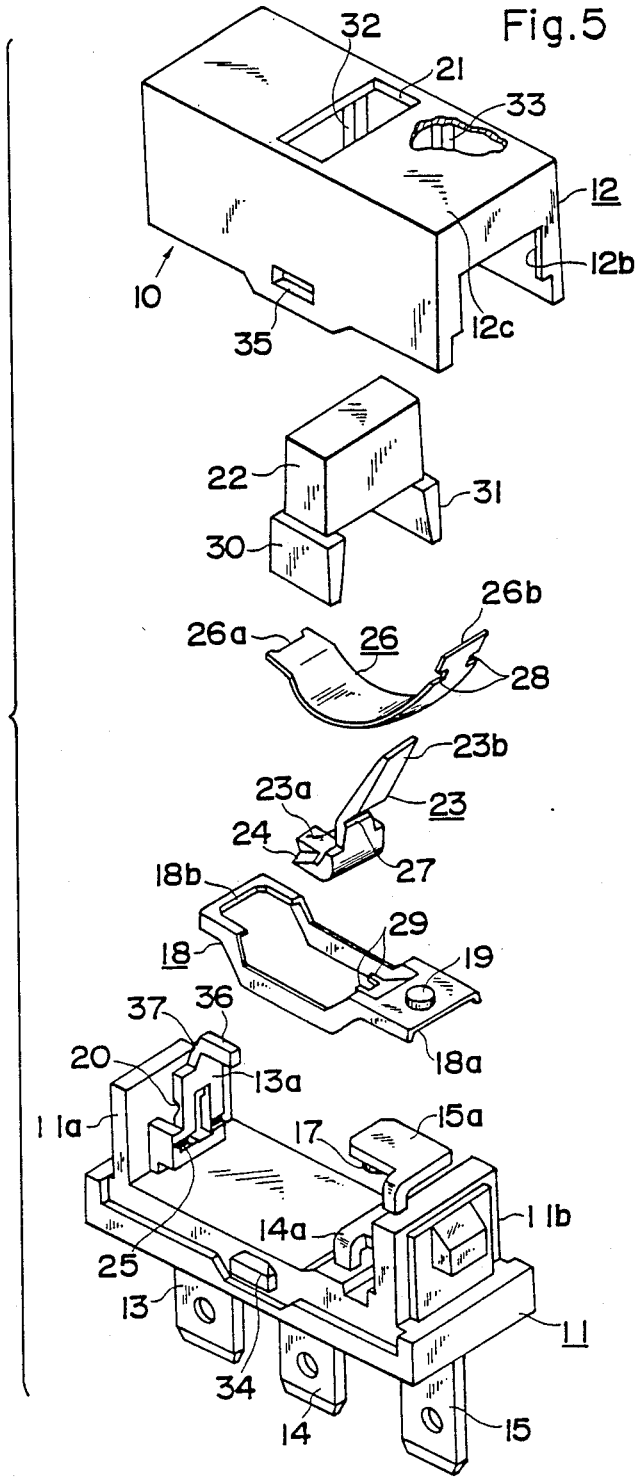
FIG. 5 is an exploded perspective view showing an example of a microswitch according to the present invention.
Figure 6A:
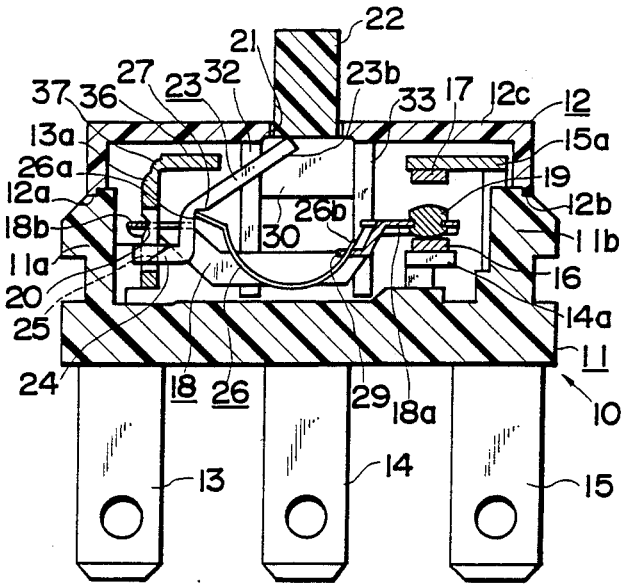
FIGS. 6*a* and 6*b* are front cross sectional views showing the microswitch in the OFF and ON states, respectively.
Figure 6B:
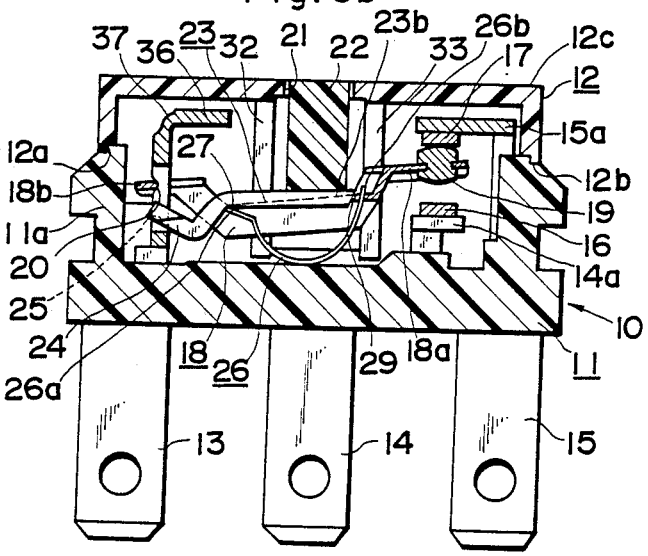

FIG. 5 is an exploded perspective view showing an example of a microswitch according to the invention. FIGS. 6*a* and 6*b* are front cross sectional views showing the microswitch in the OFF and ON states, respectively.

In the diagrams, a switch casing 10 consists of a terminal base 11 and a cover 12. The terminal base 11 is made of a plate-like synthetic resin having an electrical insulating property and constructs a lower plate of the switch casing 10. Vertically projecting portions 11*a* and 11*b* are formed on both of the left and right end portions of the terminal base 11. The cover 12 is assembled onto the terminal base 11. A pair of notched portions 12*a* and 12*b* adapted to come into engagement with the vertically projecting portions 11*a* and 11*b* are formed at both of the left and right end portions of the cover 12 made of a synthetic resin, respectively.

A common terminal member 13, a terminal member 14 for normally closed type contact, and a terminal member 15 for normally open type contact are fixed to the terminal base 11. Inner end portions 14*a* and 15*a* of the terminal members 14 and 15 are bent from lower and upper directions on the right end side in the terminal base 11 so as to face each other. Fixed contacts 16 and 17 are fixed to the opposite surfaces of the inner end portions 14*a* and 15*a*, respectively. A movable member 18 is arranged in the lateral (right/left) direction. The movable member 18 is made of a conductive material and has a almost rectangular shape having a large opening in the central portion. A movable contact 19 which faces both of the fixed contacts 16 and 17 is fixed to a free end portion 18*a*. A base end portion 18*b* is fitted into a first pivotal groove 20 formed on the left end surface of an inner end portions 13*a* of the common terminal member 13. The base end porton 18*b* is rotatably pivotally supported by this groove 20.

A rectangular hole 21 is formed in a top plate 12*c* of the cover 12 so as to be located among the inner end portion 13*a* of the common terminal member 13 and the inner end portions 14*a* and 15*a* of the terminal members 14 and 15. A push button 22 made of a synthetic resin is vertically movably inserted into the hole 21.

A swingable lever 23 is formed into a substantially S shape. An edge portion 24 formed on the side of a base end portion 23*a* of the swingable lever 23 is fitted into and rotatably pivotally supported to a second pivotal groove 25 formed on the right side surface of the inner end portion 13*a* of the common terminal member 13. A free end portion 23*b* of the lever 23 is pushed by the lower surface of the push button 22.

A compression spring 26 is made of a leaf spring and formed into an almost arc shape. A left end portion 26*a* of the spring 26 is fitted into a lateral groove 27 formed in the central portion of the swingable lever 23. Notched portions 28 formed in a right end portion 26*b* come into engagement with engaging projections 29 formed on the free end side of the movable member 28, thereby applying a return spring force to the movable member 18.

A pair of restricting plates 30 and 31, which face each other, are formed in the lower end portions of the push button 22, thereby restricting the position of the movable member 18 in the width direction. Projecting portions 32 and 33 to vertically guide the restricting plates 30 and 31 are formed on the front and rear inner walls of the cover 12, respectively.

Engaging projections 34 are formed on both of the front and rear walls of the terminal base 11. Engaging holes 35 are formed in both of the front and rear walls of the cover 12 and come into engagement with the engaging projections 34 when the cover 12 is assembled onto the terminal base 11.

A swingable lever positioning projection 36 is formed by an elongated portion of the inner end of the common terminal member 13 and is bent toward the side of the swingable lever 23. The free end portion 23*b* of the swingable lever 23 to which the left end portion 26*a* of the compression spring 26 is pivotally attached is deformed to the settable position of the push button 22 by the positioning projection 36 as will be described later. A concave portion 37 to bend the projection is formed in the inner end portion 13*a* of the common terminal member 13.

An assembling procedure of the microswitch will now be described with reference to FIGS. 7*a* to 7*f*.

Figure 7A:
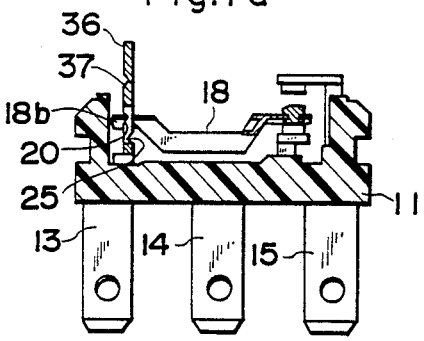
FIGS. 7*a* to 7*f* are diagrams for explaining an assembling procedure of the microswitch.
Figure 7D:
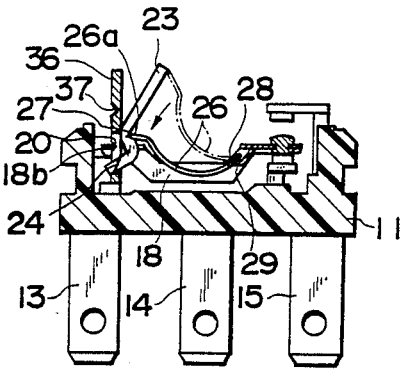
Figure 7B:
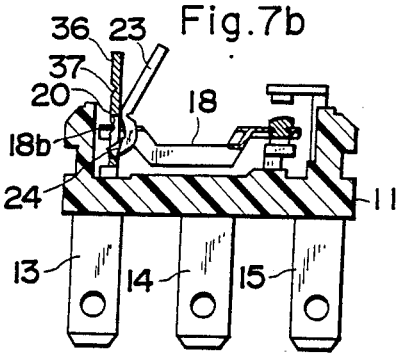
Figure 7E:
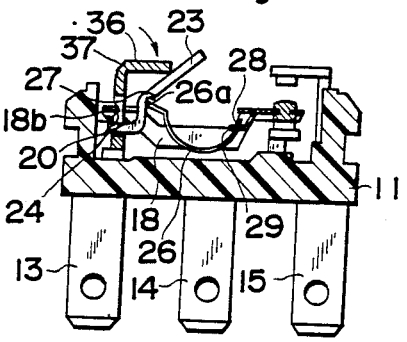
Figure 7C:
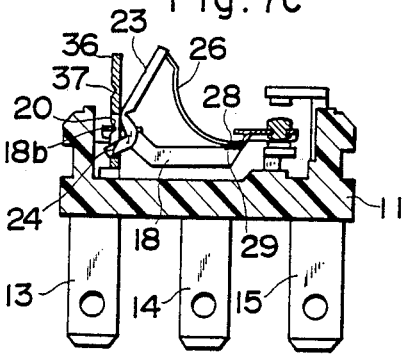
Figure 7F:
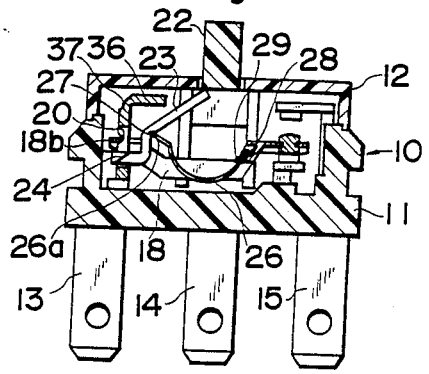

First, the base end portion 18*b* of the movable member 18 is fitted into the first pivotal groove 20 in the common terminal member 13 as shown in FIG. 7*a*. Then, the swingable lever 23 is set to an almost vertical position and the edge portion 24 is pivotally fitted into the second pivotal groove 25 as shown in FIG. 7*b*. Further, as shown in FIG. 7*c*, the notched portions 28 on the right end side of the compression spring 26 are movably attached to the engaging projections 29 on the free end portion of the movable member 18. The left end portion 26*a* of the compression spring 26 is downwardly moved along the right side surface of the swingable lever 23 and is movably fitted into the lateral groove 27 of the swingable lever 23 as shown in FIG. 7*d*. After that, in the concave portion 37, the positioning projection 36 formed in the inner end portion 13*a* of the common terminal member 13 is bent to the right as shown in FIG. 7*e*. The swingable lever 23 is inclined to the right by the projection 36, thereby positioning so that the free end portion 23*b* of the lever 23 is deformed to the settable position of the push button 22. Finally, as shown in FIG. 7*f*, by assembling the cover 12 having the push button 22 onto the terminal base 11, the push button 22 is set to the settable position of the swingable lever 23.

The operation of the above structure will now be described.

When the push button 22 is depressed from the position of FIG. 6*a*, the swingable lever 23 rotates clockwise around the pivotal supporting portion 24 (25) on the base end side as a rotational center. Therefore, the pivotal supporting portion 26*a* (27) on the left end side of the compression spring 26 is compressed while being deformed downwardly by the arc-like motion around the pivotal supporting portion 24 (25) as a rotational center. Further, by depressing the push button 22, when the left end portion 26*a* (27) of the compression spring 26 exceeds a change point corresponding to the height level position of the pivotal supporting portion 18*b* (20) on the base end side of the movable member 18 and is deformed downwardly, the spring force of the compression spring 26 is released. Thus, the free end portion 18*a* of the movable member 18 rotates counterclockwise around the pivotal supporting portion 18*b* (20) as a rotational center by the snap action. Consequently, as shown in FIG. 6*b*, the movable contact 19 is away from the normally closed type fixed contact 16 and it comes into contact with the normally open type fixed contact 17, thereby electrically connecting the terminal member 15 and the common terminal member 13.

When the pushing operation of the push button 22 is released from the state of FIG. 6*b*, the swingable lever 23 rotates counterclockwise and the movable contact 19 is returned to the original state of FIG. 6*a* by the operations opposite to the above, thereby electrically connecting the terminal member 14 for normally closed type contact 16 and the common terminal member 13.

Figure 1:
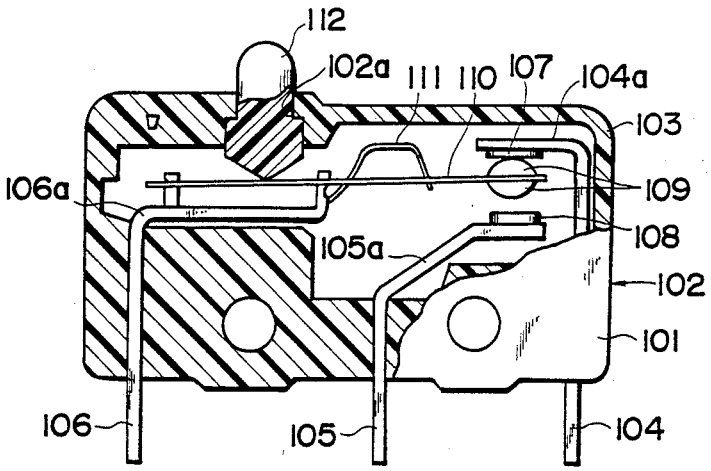
Fig. 1 PRIOR ART
FIG. 1 is a front view with a part cut away showing a conventional microswitch.
Figure 4:
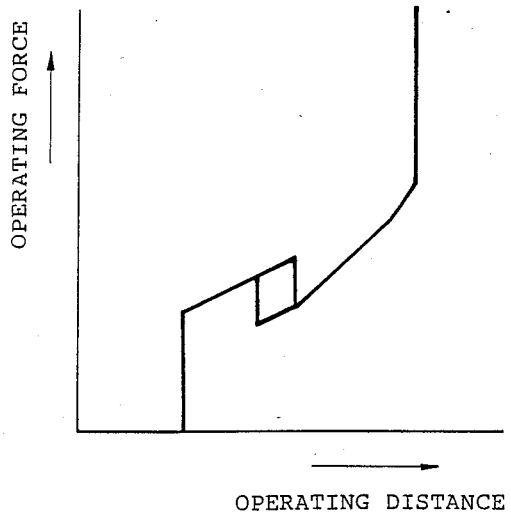
Fig. 4 PRIOR ART
FIG. 4 is a characteristic graph showing the relation between the operating distance and the operating force in a conventional microswitch.
Figure 2:
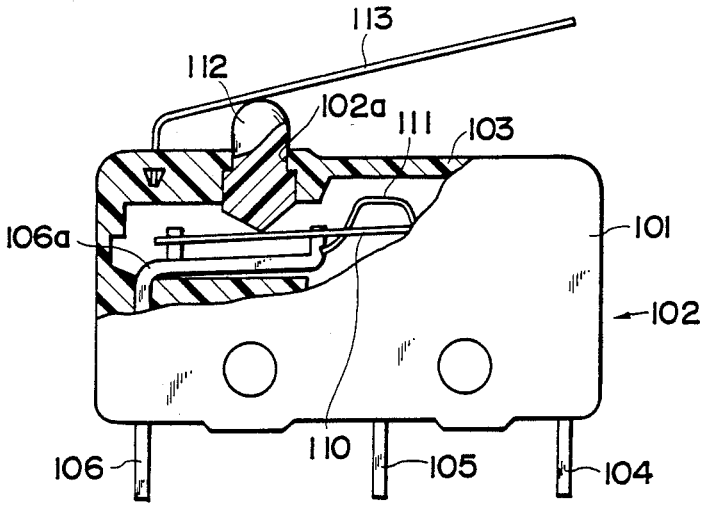
Fig.2 PRIOR ART
FIGS. 2 and 3 are front views with parts cut away showing conventional microswitches having different operating stroke enhancing means.
Figure 3:
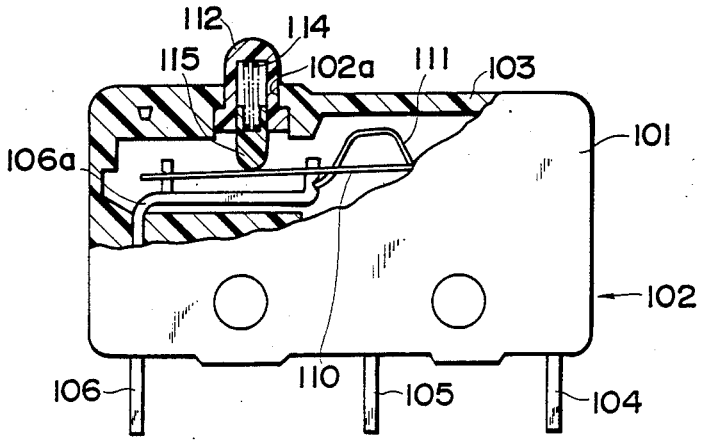
Fig.3 PRIOR ART

Since the operating force of the push button 22 is propagated to the movable member 18 through the swingable lever 23 and compression spring 26, the operating stroke can be enhanced by the swingable lever 23 and a long stroke of about 3 mm can be obtained. Moreover, the necessary space can be reduced as compared with the conventional structure (in the example shown in FIG. 2) in which the operating stroke is enhanced by the operating lever provided in the outside of the switch casing. On the other hand, the number of parts can be reduced as compared with the conventional structure (in the example shown in FIG. 3) in which the operating stroke is enhanced by the spring member arranged in the push button.

Figure 8:
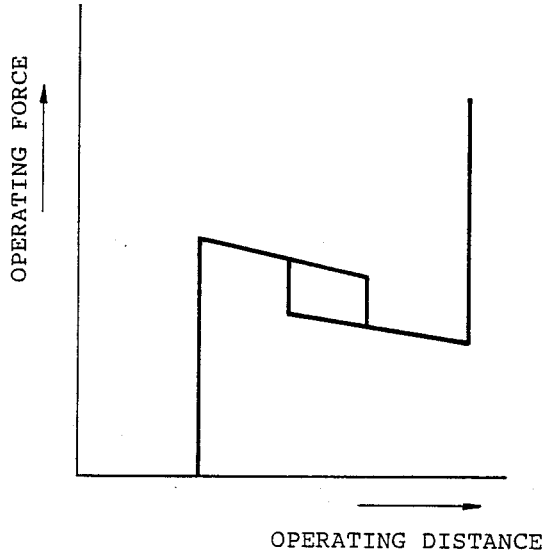
FIG. 8 is a characterisitic diagram showing the relation between the operating distance and the operating force in the microswitch.

Further, since the pivotal supporting portion 26*a* (27) with the swingable lever 23 of the compression spring 26 is moved like an arc around the pivotal supporting portion 24 (25) of the lever 23 as a rotational center, an operating characteristic as shown in FIG. 8 is derived. That is, the ratio of the change in operating force to the operating distance at a position near the operation limit position decreses and the good operating feeling can be obtained.

Figure 9:
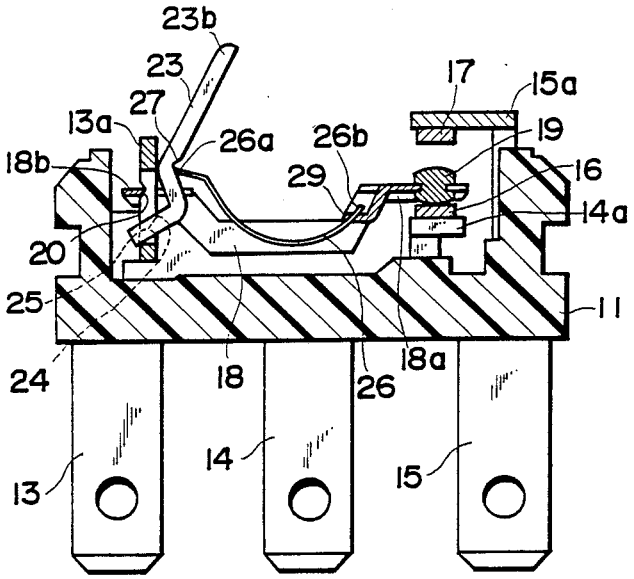
FIG. 9 is an explanatory diagram in the case where the microswitch does not have swingable lever positioning means.

If the inner end portion 13*a* of the common terminal member 13 is vertically formed as shown in FIG. 9, when the left end portion 26*a* of the compression spring 26 is pivotally fitted into the lateral groove 27 of the swingable lever 23, the lever 23 is set to a substantially vertical position as shown in FIG. 9. Therefore, when the cover 12 is attached onto the terminal base 11 by the automatic assembling process, the push button 22 does not face the free end portion 23*b* of the swingable lever 23.

In this point, according to the embodiment, the inner end elongaged portion of the common terminal member 13 is bent to thereby form the projection 36. Therefore, the swingable lever 23 is deformed to the push button settable position, so that the push button 22 faces the free end portion 23*b* of the swingable lever 23 by assembling the cover 12 onto the terminal base 11. In other words, the automatic assembling works can be easily performed and the productivity can be improved.

Figure 10:
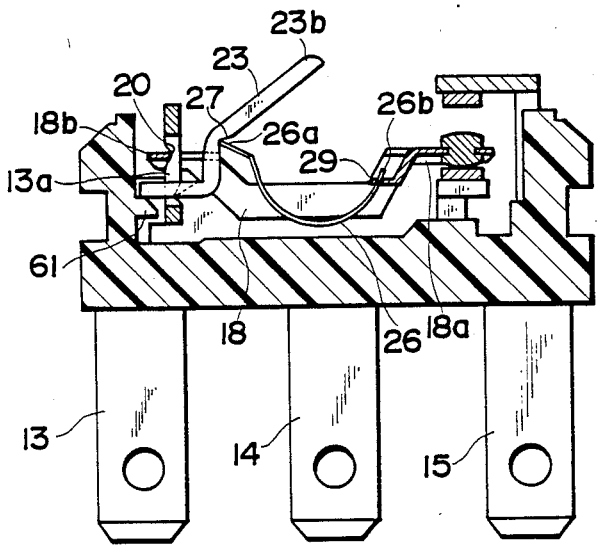
FIG. 10 is a front cross sectional view showing a modification of the microswitch in a state before a cover is attached.

In the embodiment, the swingable lever positioning projection 36 has been constructed by the bent portion 37 of the inner end portion of the common terminal member 13. However, the projection 36 can be also formed by a boss portion 61 formed on the inner wall of the terminal base 11 as shown in FIG. 10.

On the other hand, the positions of the movable member 18 and the like are restricted in the width direction by the restricting plates 30 and 31 formed under the push button 22. Also, the restricting plates 30 and 31 are guided by the projecting portions plates 32 and 33 formed on the side of the switch casing 10. Therefore, the movable member 18 and the like are properly held without shaking.

Although the foregoing example has been described with respect to the structure having a pair of terminal members 14 and 15, the invention can be also applied to a structure having one fixed terminal member.

What is claimed is:

1. A microswitch comprising:

a switch casing in which a first common terminal member and at least one second terminal member for fixed contact are fixed to a lower plate portion;

a hole formed in a top plate of the switch casing located between inner end portions of said first common terminal member and said second terminal member for fixed contact;

a push button which is vertically movably inserted into said hole;

a movable member provided with a movable contact at a free end portion thereof and pivotally supported at the inner end portion of the first common terminal member at a base end portion thereof, said movable contact facing a fixed contact fixed to the inner end portion of the second terminal member, a swingable lever pivotally supported at the inner end portion of the first common terminal member at a base end portion thereof and operated by said push button at a free end thereof wherein said push button is capable of moving towards a space located between the base end portion of said swingable lever and the free end portion of said movable member; and a compression spring, one end of which is pivotally engaged with a central portion of said swingable lever and another end of which is engaged with a free end portion of said movable member.

2. A microswitch according to claim 1, wherein a swingable lever positioning projection is provided in said switch casing to deform the free end portion of said swingable lever.

3. A microswitch according to claim 1, wherein a positioning projection for said swingable lever is formed by a bent member on the inner end side of said common terminal member.

4. A microswitch according to claim 1, further having:

a pair of front and rear restricting members, formed vertically downwardly at lower ends of said push button, for restricting the position of said movable member in a width direction; and guide portions, formed on an inner wall of said switch casing, for guiding the vertical motions of said restricting members.

* * * * *

UNITED STATES PATENT AND TRADEMARK OFFICE

CERTIFICATE OF CORRECTION

PATENT NO. : 4,904,832

DATED : February 27, 1990

INVENTOR(S) : Toyohiro NAGAHARA et al.

It is certified that error appears in the above-identified patent and that said Letters Patent is hereby corrected as shown below:

Front page, lefthand column, under Foreign Application Priority Data: change "62-154541" to --62-154541 [U]--.

Signed and Sealed this

Sixteenth Day of July, 1991

*Attest:*

*Attesting Officer*

HARRY F. MANBECK, JR.

*Commissioner of Patents and Trademarks*